United States Patent [19]

Shapiro

[11] 3,946,512

[45] Mar. 30, 1976

[54] SLOTTED TURN-A-FRAME

[76] Inventor: Marilyn R. Shapiro, 3327 Ripple Road, Baltimore, Md. 21207

[22] Filed: Jan. 2, 1975

[21] Appl. No.: 538,180

[52] U.S. Cl. ..... 40/152.1
[51] Int. Cl.[2] ..... G09F 1/12
[58] Field of Search ..... 40/154, 152.1, 152, 158, 40/128

[56] References Cited

UNITED STATES PATENTS

| | | | |
|---|---|---|---|
| 54,208 | 4/1866 | Rice | 40/154 |
| 194,368 | 8/1877 | Phillips | 40/158 R |
| 390,473 | 10/1888 | Green | 40/152 |
| 950,912 | 3/1910 | Harrington | 40/128 X |
| 2,515,053 | 7/1950 | Nesel | 40/152.1 |
| 2,791,051 | 5/1957 | Scheyer | 40/152.1 |
| 2,809,454 | 10/1957 | Maynard | 40/152.1 |

*Primary Examiner*—Louis G. Mancene
*Assistant Examiner*—Wenceslao J. Contreras
*Attorney, Agent, or Firm*—Walter G. Finch

[57] ABSTRACT

A frame assembly is provided having an outer frame and an inner frame secured to the outer frame. Mounting boards are provided on either side of the inner frame. Pairs of spaced slots are provided on the inner surface of the outer frame and arranged on opposite sides of the inner frame for receiving mounting fixtures for mounting the frame assembly in either a reversed, horizontal or vertical position.

5 Claims, 3 Drawing Figures

SLOTTED TURN-A-FRAME

The present invention relates generally to frame assemblies, and more particularly it pertains to a frame arrangement which can be reversed and arranged in a number of positions for displaying pictures, photographs, paintings or posters of various types.

It is an object of this invention to provide a frame assembly which can be reversed to display more than one painting, picture, poster or the like.

Another object of this invention is to provide a frame assembly which can be utilized in both a horizontal as well as a vertical position, and which can be readily reversed, for displaying pictures, posters, paintings, or the like.

Still another object of this invention is to provide a frame assembly which is economical to manufacture, and which is readily adaptable for displaying paintings, pictures, posters of the like, in a number of selected positions.

And even another object of this invention is to provide a frame assembly which is easy to install and to remove from a supporting structure.

These and other objects and attendant advantages of this invention will become more obvious and apparent from the following detailed description and accompanying drawings wherein.

Figure 1:
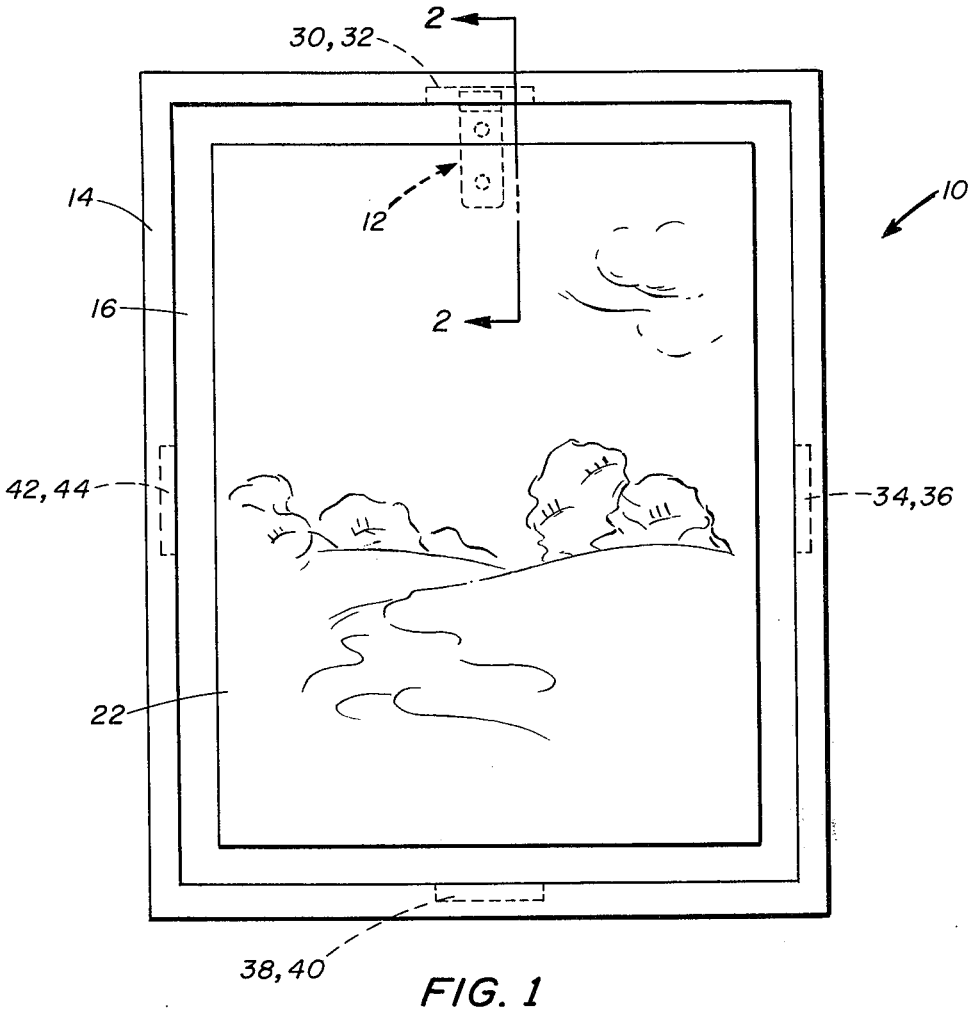
FIG. 1 is a front view of the frame assembly incorporating features of this invention.

Referring now to FIG. 1 of the drawings, there is shown a complete rectangular shape frame assembly 10 incorporating features of this invention. Frame assembly 10 consists of a rectangular shaped outer frame 14 having two vertical sides and two horizontal sides joined together at their ends and forming the outer frame.

Figure 2:
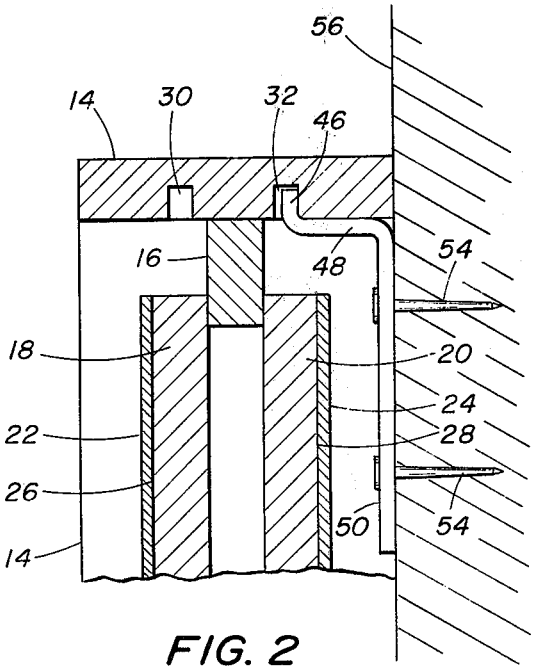
FIG. 2 is a partial sectional view taken along line 2—2 of FIG. 1.

As shown in FIG. 2, an inner frame 16 extends transversely inwardly from the edge portions of the outer frame 14. This inner frame 16 likewise is provided with two vertical members and two horizontal members joined together at their respective ends to form the inner frame 16.

The inner frame 16 can be secured to the outer frame 14 by any suitable means, such as by adhesive, by nails, or screws.

Flat mounting boards 18 and 20 are secured, by suitable means, to the opposite sides of the inner frame 16. An adhesive 26 or 28 is secured to the outer face of each mounting board 18 and 20, respectively, for securing a picture, poster, painting, or the like to the opposite outer faces of the mounting boards.

The outer frame 14 is provided on its inner surface with pairs of spaced slots 30,32; 34,36; 38,40; and 42,44; and on the opposite sides of the inner frame 16, at the top, two sides, and bottom, as shown best in FIGS. 1 and 2.

Figure 3:
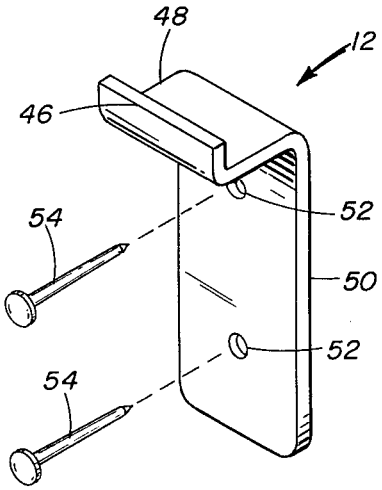
FIG. 3 is a perspective view of a wall hook with attaching hardware.

As shown in FIGS. 2 and 3, a wall bracket or fixture 12 is provided for hanging the frame assembly 10 in any number of positions, either horizontal, vertical, or reversed. This wall bracket 12 consists of a support 50 having an extending portion 48 arranged transversely thereto, with an upwardly extending lip 46. The support 50 is provided with a pair of spaced apertures 52 for receiving nails or screws 54 for securing the support 50 to a fixed support, such as a wall 56.

In use, the frame assembly 10 can have pictures, posters, paintings, photographs, or the like 22 or 24, secured to opposite sides of the inner frame 16, in either a horizontal or vertical position by means of the adhesive 26 or 28 positioned on mounting boards 18 and 20, depending upon the choice of the user of the framed picture. The frame assembly 10 is secured to the wall 56 by means of the lip 46 of support 50. For example, in FIG. 2, slot 32 receives the lip 46 of the support 50. If it is desired to reverse the frame assembly 10, then use would be made of slot 30 in the outer frame 14.

On the other hand, if it is desired to mount the frame assembly 10 in a horizontal position, then use would be made of the slots 34,36 or 42,44, depending upon what photograph, painting, picture, or poster the viewer would desire to see on his wall.

Thus, the same frame assembly 10 of FIGS. 1, 2 and 3, can be utilized to view photographs, paints, pictures or posters from both sides of the frame assembly, and/or vertically and horizontally, as desired and selected.

Obviously many modifications and variations of the present invention are possible in light of the above teachings. It is, therefore, to be understood that within the scope of the appended claims the invention may be practiced otherwise than as specifically described.

What is claimed is:

1. A reversible frame assembly mountable to bracket means on a vertical wall surface, comprising:

an outer frame having an inner surface, the outer frame being provided with a pair of spaced slots formed in the inner surface of said outer frame;

an inner frame secured to the inner surface of the outer frame between the spaced slots, the inner frame having opposite faces; and, viewing material secured to each of the opposite faces of the inner frame, the spaced slots in the inner surface of the outer frame mounting the frame assembly to the bracket means disposed on said vertical wall surface, each one of the slots alternatively mounting the frame assembly on disposition of the given slot in facing relation to said vertical wall surface.

2. The reversible frame assembly of claim 1 wherein the inner surface of the outer frame is substantially horizontal when mounted to said vertical wall surface and the opposite faces of the inner frame are substantially vertical, the outer frame and inner frame connecting at right angles to form a T-shaped cross-section.

3. The reversible frame assembly of claim 1 wherein:

the outer frame is substantially rectangular and includes four outer frame elements joined at right angles to each other, inner portions of the outer frame elements forming the inner surface of the outer frame; and, the inner frame is substantially rectangular and includes four inner frame elements joined at right angles to each other, each of the inner frame elements securing to one each of the outer frame elements on the inner portion thereof, each of the outer frame elements having a pair of spaced slots formed in the inner portion thereof, each of the spaced slots being located on the opposite side of each of the inner frame elements from the other slot of said pair of spaced slots.

4. The reversible frame assembly of claim 1 and further comprising:

a mounting board secured to each face of the inner frame for mounting said viewing material.

5. The reversible frame assembly of claim 1, wherein said outer frame is provided with pairs of spaced slots at the top, bottom, and sides thereof for mounting said frame assembly in either a horizontal, vertical, or reversed position.

* * * * *